United States Patent [19]

Rohrman

[11] Patent Number: 4,760,622

[45] Date of Patent: Aug. 2, 1988

[54] COMPOUND WINDING APPARATUS AND COUNTERBALANCE SYSTEMS

[75] Inventor: Henry Rohrman, Jenkintown, Pa.

[73] Assignee: Schlegel Corporation, Chester, N.Y.

[21] Appl. No.: 892,704

[22] Filed: Jul. 31, 1986

[51] Int. Cl.[4] ..... E05D 13/00; B65H 75/48

[52] U.S. Cl. ..... 16/196; 16/198; 254/364; 254/374; 248/572; 49/446; 242/107.5

[58] Field of Search ..... 16/196, 197, 198; 242/107, 107.5; 49/429, 445, 446; 254/277, 285, 336, 364, 374; 248/330.1, 572

[56] References Cited

U.S. PATENT DOCUMENTS

| | | | |
|---|---|---|---|
| 42,864 | 5/1864 | Morgan | 254/374 |
| 97,263 | 11/1869 | Anderson . | |
| 576,316 | 2/1897 | Hunt | 254/374 |
| 1,155,181 | 9/1915 | Wilkinson | 254/374 |
| 1,669,990 | 5/1928 | Mantz . | |
| 2,010,214 | 8/1935 | Braun | 16/198 |
| 2,262,990 | 11/1941 | Cross et al. | 16/197 |
| 2,320,413 | 6/1943 | Cummings | 16/198 |
| 2,453,424 | 11/1948 | Foster | 16/198 |
| 2,774,119 | 12/1956 | Osten | 20/52 |
| 2,901,202 | 8/1959 | Stava et al. | 248/572 |
| 2,952,884 | 9/1960 | Dinsmore | 20/52.2 |
| 3,046,618 | 7/1962 | Teggelaar | 20/52.4 |
| 3,055,044 | 9/1962 | Dinsmore | 16/197 |
| 3,095,922 | 7/1963 | Frazier | 160/191 |
| 3,335,455 | 8/1967 | Anderson | 16/198 |
| 3,615,065 | 10/1971 | Elliot | 242/107 |
| 4,012,008 | 3/1977 | Hosooka | 242/107 |
| 4,067,545 | 1/1978 | Singer | 254/364 |
| 4,078,336 | 3/1978 | Prosser | 49/445 |
| 4,238,907 | 12/1980 | Swan | 49/446 |
| 4,389,228 | 6/1983 | Leunig | 55/379 |
| 4,586,291 | 5/1986 | Swan | 49/501 |

FOREIGN PATENT DOCUMENTS

| | | |
|---|---|---|
| 329285 | 5/1930 | United Kingdom . |
| 430457 | 6/1935 | United Kingdom . |
| 1002338 | 8/1965 | United Kingdom . |
| 1525758 | 9/1978 | United Kingdom . |

OTHER PUBLICATIONS

British Examiner's Search Report dated Oct. 9, 1987.

*Primary Examiner*—Nicholas P. Godici
*Assistant Examiner*—Edward A. Brown
*Attorney, Agent, or Firm*—Steele, Gould & Fried

[57] ABSTRACT

A compound counterbalance system for window sashes and the like, comprising: a biasing mechanism for easing operation of a window sash and the like, the biasing mechanism being movable at an inherently variable of force; a first biasing force transmission, connected intermediately of the window sash and the like and the biasing mechanism, for increasing the effective range of movement of the biasing mechanism; and, a second biasing force transmission connected intermediately of the first biasing force transmission and the biasing mechanism, the second biasing force transmission having a variable rate of operation predetermined to automatically compensate for the variability of the biasing mechanism, to provide substantial constancy of the biasing force. The biasing mechanism preferably comprises a linearly extensible and contractible spring. In one embodiment, both the first and second biasing force transmissions comprise pulley and cable systems. In another embodiment, only the second biasing force transmission comprises a cable and pulley system and the first biasing force transmission comprises a reduction gear assembly. In each embodiment, the variable rate of the second biasing force transmission comprises a generally conical, spiral-grooved pulley and a cable means affixed at one end to the pulley, affixed at the other end to the biasing mechanism and adapted to wind into and out of the groove.

25 Claims, 7 Drawing Sheets

COMPOUND WINDING APPARATUS AND COUNTERBALANCE SYSTEMS

BACKGROUND OF THE INVENTION

1. Field of the Invention

This invention relates to the field of compound winding apparatuses and to counterbalance systems for window sashes and the like, and more particularly, to a compound counterbalance system incorporating a compound winding apparatus and comprising: biasing means for easing operation of a window sash and the like, the biasing means being movable in part at an inherently variable rate of force; a first biasing force transmission means, connected intermediately of the window sash and the like and the biasing means, for increasing the effective range of movement of the biasing means; and, a second biasing force transmission means connected intermediately of the window sash and the like and the biasing means, the second biasing force transmission means having a variable rate of operation predetermined to automatically compensate for the variability of the biasing means to provide a substantial constancy of the biasing force.

2. Prior Art

Counterbalance systems for window sashes and the like have been known for some time, particularly in conjunction with double hung window frames. The original counterbalance systems for such windows utilized sash weights hung by cables and pulleys, and running in large cavities to one or both sides of the window frames. Such counterbalance systems made such windows practical, but at the same time, were extremely energy inefficient. The large cavities in which the pulleys were disposed provided effective conduits for drafts running along and through the windows and the walls in which the windows were mounted. Such counterbalance systems did have one advantage, namely that the pull exerted by the sash weight was constant throughout the reciprocating range of movement of the window sashes.

A number of developments have impacted on the design of windows and counterbalance systems for windows, resulting in the inevitable obsolescence of the sash weight and pulley system. Technology has been developed to manufacture windows much less expensively off-site, in fully functioning assemblies. Such assemblies incorporate within their own structure the necessary counterbalance system. Cavities for sash weights to counterbalance windows are no longer even designed or otherwise provided for today. Accordingly, spring balances were incorporated into such manufactured window assemblies. Spring balances are advantageous in that their tension can be easily adjusted, whereas changing sash weights in a major undertaking. The ability to provide adjustable tension has proven especially important today, as energy conservation requirements demand that windows be very tightly sealed against drafts and that they provide substantial insulation. It is not generally appreciated by consumers at large that highly efficient weather stripping and weather seals exert large amounts of sliding friction, making windows and other systems incorporating such seals much more difficult to operate. Adjustably tensioned springs permit manufacturers to compensate for the additional tension which is necessary for a well-sealed and well-insulated window. Insulated windows require additional panes of glazing, increasing the weight of the sash. However, counterbalance systems incorporating springs have simply never worked as well as did sash weights, when windows were substantially unsealed, because such springs have inherent unconstant spring rates or gradients, that is, the amount of tension exerted by the spring changes according to the extent to which the spring is extended or relaxed.

In today's marketplace, window manufacturers are faced with two critical goals, namely achieving thermal efficiency (i.e., insulation and very low air infiltration), and at the same time, achieving low operating forces. There is a direct conflict in these two goals, as tightly-fitted, heavy window assemblies inherently generate higher operating forces due to friction and gravity. Today's counterbalance systems are simply not responsive to today's needs.

As might be expected, the prior art is replete with counterbalance systems for window sashes and the like, in what seems to be, at least initially, the widest variety of mechanical systems. A number of patent references disclose the use of spiral drums to compensate for tension changes in a spring, but in each instance, the spiral drum appears to have been mounted coaxially with and axially driven by the spring, and both the spring and the spiral drum have been disposed in a cavity above or below the window. Moreover, none of these patent references has used the spiral drums in further combination with a pulley system or other means for imparting a mechanical advantage, which in turn increases the effective range of movement of the biasing means. The following United States patents are representative of such teachings: U.S. Pat. Nos. 97,263; 1,669,990; 2,010,214; 2,453,424; 3,095,922; 3,615,065; and, 4,012,008.

Patent references have also disclosed windows utilizing side mounted springs and pulley systems, most of the pulley systems being arranged in a block and tackle arrangement to achieve a mechanical advantage. However, the systems disclosed in these references require all available space, and none incorporates a means compensating for changes in spring tension. United States patents representative of such teachings include: U.S. Pat. Nos. 2,262,990; 2,952,884; 3,046,618; 3,055,044; 4,078,336; and 4,238,907.

Certain references have also provided alternative solutions to compensation of variable spring rates in tensioning means, other than spiral drums and in other contexts. In U.S. Pat. No. 4,389,228 the sheaves of pulleys are so close together that only one diameter of rope or cable can fit there between. The effective diameter of the pulley therefore changes with each rotation as more of the cable is wound onto, or paid out from the drum. Other solutions are disclosed in the following United States patents: U.S. Pat. Nos. 2,774,119 and 3,335,455.

Compound winding apparatus and counterbalance systems for window sashes and the like, according to this invention, overcome all of the problems now plaguing prior art window assemblies. A compound counterbalance system according to this invention is the first such system which is sufficiently compact and sufficiently efficient to interconnect and utilize: (1) an axially expansible and contractible biasing means, (2) a constant rate of movement system providing a mechanical advantage, and (3) a variable rate of movement system to automatically compensate for inherent variability in the tension of the biasing means. Moreover, the biasing means itself is nevertheless easily adjustable.

Finally, compound counterbalance systems according to this invention can be easily incorporated into off-site manufactured assemblies.

The term mechanical advantage, as used in the constant rate of movement system, requires some clarification to be meaningful in the context of this invention. There is a "cost" for every mechanical advantage. In the context of pulleys, as used in block and tackle assemblies, one can achieve significant mechanical advantage in raising a heavy load, but the load moves at a speed which is inversely proportional to the ratio of mechanical advantage, that is, much slower. The distance through which the load moves is also much less than the supporting cable at its driven end. In the context of gear systems, the "cost" is a rotational reduction. Where speed is more important than power, a mechanical disadvantage is preferred, as in an automobile's overdrive transmission. In the context of levers, a longer moment arm for the driven end of a lever will move a heavier load, but through a shorter distance, relative to the driven end. For this invention, a window sash or the like must move further than the expansion space available for, as an example, an axially extensible spring; considerably further.

The various mechanical advantage systems utilized in this invention enable maximum range of sash movement and, at the same time, minimum range of movement for expansion for appropriate parts of the biasing means. Nevertheless, the various embodiments maintain a mechanical advantage in stressing or extending the biasing means. Compound counterbalance systems according to this invention successfully exploit the "cost" of mechanical advantage systems without, in fact, sacrificing all of the benefits. Moreover, the variable rate of movement system, which is embodied in a compound winding apparatus and compensates for variability in the tension of the biasing means, can be embodied in small dimensions which further reduce space requirements for window sashes and in other applications.

SUMMARY OF THE INVENTION

It is an object of this invention to provide an improved counterbalance system for window sashes and the like.

It is another object of this invention to provide a compound counterbalance system for window sashes and the like.

It is yet another object of this invention to provide a compound counterbalance system for window sashes and the like, incorporating a biasing means or system, incorporating a variable rate means or system for automatically compensating for inherent variability in the tension of the biasing means or system, and incorporating a constant rate mechanical advantage system.

It is yet another object of this invention to provide a compound counterbalance system for window sashes and the like, which can accommodate highly efficient weather seals and heavily insulated sashes, and at the same time, is easy to operate, and can be operated with substantially constant effort.

It is yet another object of this invention to provide a compound winding apparatus for counterbalance systems and the like.

It is yet another object of this invention to provide an improved method for counterbalancing.

These and other objects of this invention are accomplished by a compound counterbalance system for window sashes and the like, comprising: biasing means for easing operation of a window sash and the like, the biasing means being movable in part at an inherently variable rate of force; a first biasing force transmission means, connected intermediately of the window sash and the like and the biasing means, for increasing the effective range of movement of the biasing means; and, a second biasing force transmission means connected intermediately of the first biasing force transmission means and the biasing means, the second biasing force transmission means having a variable rate of operation predetermined to automatically compensate for the variability of the biasing means, to provide substantial constancy of the biasing force.

In a first embodiment, the biasing means comprises an axially extensible spring, having one fixed end and one movable end; the second biasing force transmission means comprises: a generally conical, spiral-grooved pulley and a cable drum of constant diameter fixed for rotation together; a first cable means affixed at one end to the pulley, affixed at the other end to the movable end of the biasing means and adapted to wind into and out of the groove as the spring extends and contracts; and, a second cable means affixed at one end to the cable drum and adapted to wind onto and off from the cable drum and connectable to the first biasing force transmission means at the other end; and, the first biasing force transmission means comprises pulleys and cable means interconnected to form a block and tackle assembly, the cable means being entrained around the pulleys to achieve a mechanical advantage for the system which allows the sash to move multiples of the distance traveled by the movable end of the block and tackle assembly, thereby reducing the distance the spring would otherwise be required to extend.

In another embodiment, the biasing means comprises an axially extensible spring, having one fixed end and one movable end; the second biasing force transmission means comprises: a generally conical, spiral-grooved pulley, a first cable means affixed at one end to the pulley, affixed at the other end to the movable end of the biasing means and adapted to wind into and out of the grooves as the spring extends and contracts; and, the first biasing force transmission means comprises: gear means having at least one gear reduction set to achieve a mechanical advantage for the system which, although reducing the biasing force transmitted to the sash, correspondingly reduces the distance the spring otherwise would be required to extend; a cable drum of constant diameter; and, a second cable means affixed at one end to the cable drum and adapted to wind onto and off from the cable drum and connectable to the window sash and the like. In this embodiment, the gears are preferably formed integrally with each of the generally conical pulley and the cable drum.

In an alternative embodiment of the pulley and cable system, the second biasing force transmission means comprises a winding means having a cable drum of constant diameter and a cable means which varies in diameter from a widest diameter adjacent the movable end of the block and tackle assembly to the smallest diameter adjacent the movable end of the biasing means. In another alternative embodiment, the cable drum is only as wide as the diameter of the second cable means thereon, thus changing the effective diameter of the cable with each turn. This embodiment requires less space.

These and other objects of the invention are also accomplished by a compound counterbalance system as described above, in combination with a manufactured window assembly having at least one openable window sash.

These and other objects of the invention are further accomplished by a method for improved counterbalancing, comprising the steps of: exerting by movement a biasing force on a load against forces tending to retard movement thereof; compounding the biasing force with a compensating force at a variable rate predetermined to automatically compensate for characteristic variability of the biasing force to provide a substantially constant compound biasing force; and, transmitting the substantially constant compound biasing force to the load through a mechanical system configured to increase the distance of travel of the load relative to biasing movement during exertion of the biasing force, whereby the effect of the biasing force is enhanced and uniform. The method preferably comprises the further step of exerting the biasing force by substantially linear extension and contraction of the spring means.

For counterbalance systems generally, these and still further objects of the invention are accomplished by a compound winding apparatus, comprising: a generally conical, spiral-grooved pulley adapted to engage a first cable means windable into and out of the spiral groove at a variable rate as the pulley rotates; a drum adapted to engage a second cable means windable onto and off of the drum at a substantially constant rate as it rotates, the pulley and the drum being at least indirectly engaged to undergo simultaneous rotation; and, the variable rate being predetermined to automatically compensate for inherent variation in a biasing force transmitted through one of the first and second cable means, whereby a substantially constant force is transmitted through the other of the first and second cable means.

In one embodiment the pulley and drum are fixed together for rotation or even formed integrally. In another embodiment the pulley and drum are indirectly linked by mechanical means for rotation at the same speed or at different speeds.

Other objects and advantages of this invention will become apparent to those skilled in the art from the following detailed description of the preferred embodiments of the invention.

BRIEF DESCRIPTION OF THE DRAWINGS

There are shown in the drawings forms which are presently preferred: it being understood, however, that the invention is not limited to the precise arrangements and instrumentalities shown.

Figure 21:
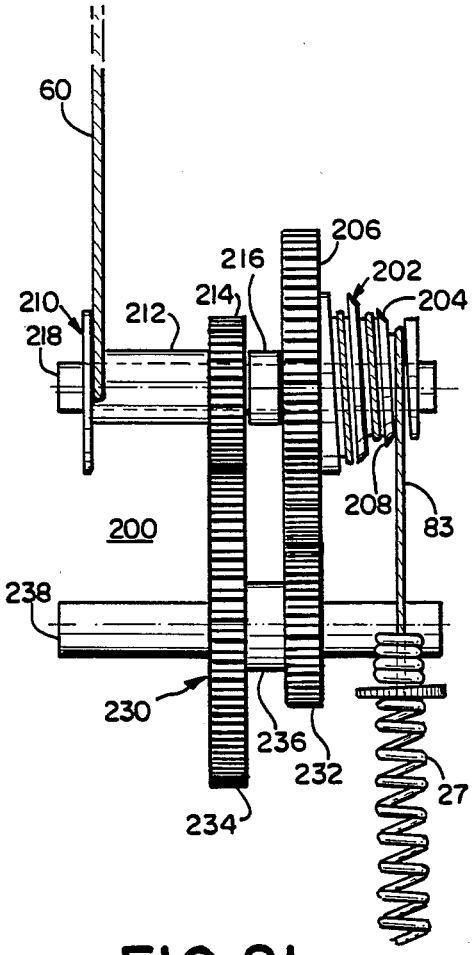
Figure 22:
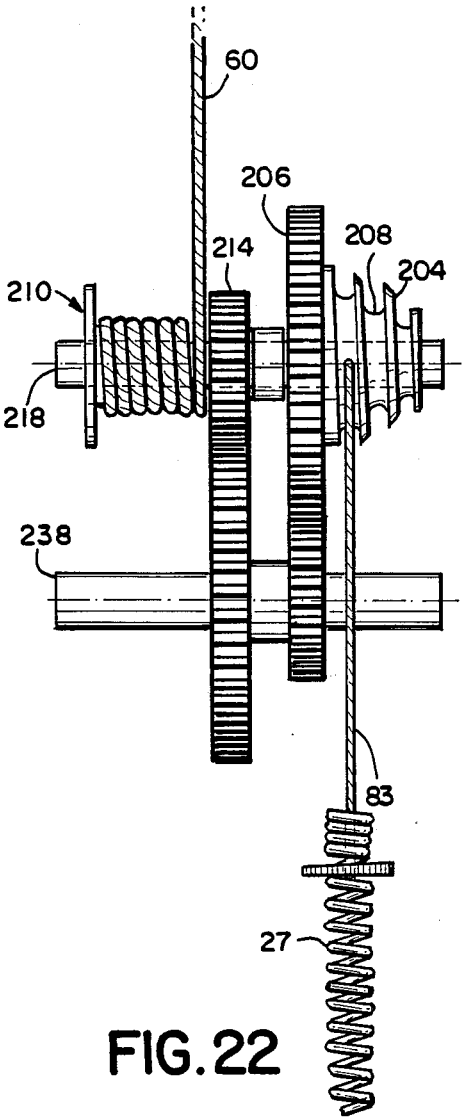
Figure 23:
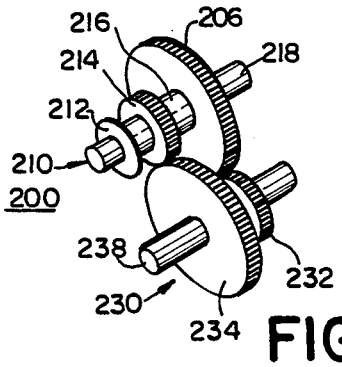

FIGS. and 21 and 22 illustrate an alternative embodiment utilizing sets of reduction gears instead of the block and tackle assembly; and, FIG. 23 is a perspective view, in reduced scale and partially diagrammatic form, of the reduction gear sets shown in FIGS. 21 and 22.

DETAILED DESCRIPTION OF THE PREFERRED EMBODIMENTS

Various embodiments of compound counterbalance systems for window sashes and the like, according to this invention, are shown in the drawings. Generally, each of the compound counterbalance systems incorporates a compound winding apparatus. More specifically, each of the compound counterbalance systems comprises three principal subsystems or assemblies, namely a biasing means for easing operation of a window sash and the like, the biasing means being movable in part at an inherently variable rate of force; a first biasing force transmission means, connected intermediately of the window sash and the like and the biasing means, for increasing the effective range of movement of the biasing means; and, a second biasing force transmission means connected intermediately of the first biasing force transmission means and the biasing means, the second biasing force transmission means having a variable rate of operation predetermined to automatically compensate for the variability of the biasing means, to provide substantial constancy of the biasing force. In the embodiment shown in FIGS. 1–20, both the first and second biasing force transmission means comprise cable systems. In the embodiment shown in FIGS. 21–23, the first biasing means comprises a gear system.

Figure 1:
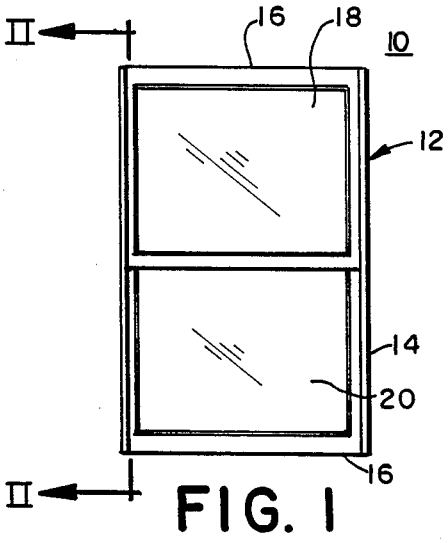
FIG. 1 is a front elevation of an otherwise typical manufactured double hung window assembly, incorporating compound counterbalance systems according to this invention.

An off-site manufactured window assembly 10 incorporating compound counterbalance systems according to this invention is shown in FIG. 1. The window assembly 10 comprises a frame 12 having vertical members 14 and horizontal members 16. An upper sash or vent 18 is closed in the upper position, as illustrated in FIG. 1, and is opened by downward movement, with respect to the orientation of FIG. 1. A lower sash or vent 20 is closed in the lower position as shown in FIG. 1, and is opened by upward movement. The terms horizontal and vertical are used for purposes of convenience, and it is not absolutely necessary that the window assembly be disposed vertically.

Figure 2:
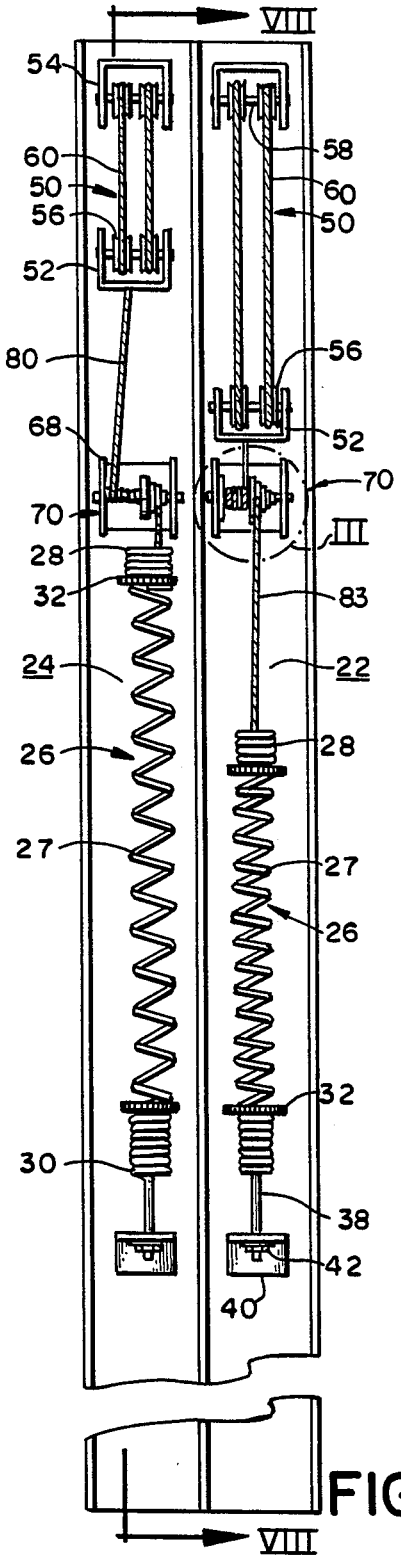
FIG. 2 is a section view taken along the line II—II in FIG. 1.

The window assembly 10 has two pairs of compound counterbalance systems according to this invention, one pair for each of the upper and lower sashes 18 and 20. One of each pair is disposed in the left hand one of the vertical members 14, as shown in FIG. 2. Compound counterbalance system 22 is provided for the left side of upper sash or vent 18 and compound counterbalance system 24 is provided for the left side of lower sash or vent 20. The compound counterbalance systems 22 and 24 are essentially identical to one another. It will be appreciated that such counterbalancing should occur on each of the left and right sides of each sash. This can be accomplished by providing counterbalance systems on each side of the window frame, or by connecting both sides of the sash to the counterbalance system. Only one "side" is illustrated for purposes of clarification.

Each of the compound counterbalance systems 22 and 24 comprises a biasing means or system 26, a constant rate (of movement) cable means or system 50 and a variable rate (of movement) cable means or system 70. The biasing means or system 26 is an axially and linearly extensible and contractible biasing means, for example, a helically wound spring 27 as shown. Each spring 27 has a movable end 28 and a fixed end 30. An adjustment knob 32 (see FIGS. 6 and 7) is disposed adjacent each end of the spring. A rod 34 has a head 35 which is larger in diameter than a hole 37 in the middle of adjustment knob 32. Rod 34 has a threaded end 38 which passes through a hole in bracket 40 and is secured in place by a nut and lock washer assembly 42. The adjustment knob 32 has a radial slit 46 which enables the facing slit edges of the knob to be bent upwardly and downwardly relative to one another at an angle a. The movable end of the spring may be directly connected to a cable, by having the cable pass through the hole 37 and have a retainer or fitting (not shown) affixed thereto, the size of the retainer being larger than hole 37. The dimensions of knob 32 are such that the turns of the spring fit between the separated edges of the knob 32. Rotation of the knob(s) 32 effects axial movement of the knob(s), such that the number of turn of the spring under tension can be increased or decreased, thereby enabling the magnitude of the tension to be adjusted. Adjustment can also be effected by the extent to which threaded end 38 is pulled or tightened through bracket 40. Such adjustments may affect the range of magnitude of the spring gradient, but will not compensate for the gradient.

The constant rate cable means or system 50 has a movable end defined by a bracket 52 and a fixed end defined by a bracket 54. Brackets 52 and 54 may be substantially identical to one another. Each of the brackets 52, 54 has pulleys 56 disposed on mounting shafts 58. The pulleys 56 are engaged by a first cable means 60 so as to form a block and tackle assembly providing a mechanical advantage in the system. In the illustrated embodiment, the ratio of the mechanical advantage, as viewed from the window sash to the spring, is 4:1; and as viewed from the spring to the window sash, is 1:4 (that is, a disadvantage). However, due to the so-called mechanical disadvantage, the window sash travels four times the distance traveled by movable bracket 51. One end of the cable means 60 is entrained over a guide pulley 62 and affixed to a window sash (see FIGS. 8 and 9). The arrangement increases the effective range of movement of the biasing means. The window sash travels a distance which is a multiple of the movable part of the biasing means determined by the mechanical ratio. Increasing the effective range of movement of the biasing means enables the compound counterbalance system to be smaller.

Figure 3:
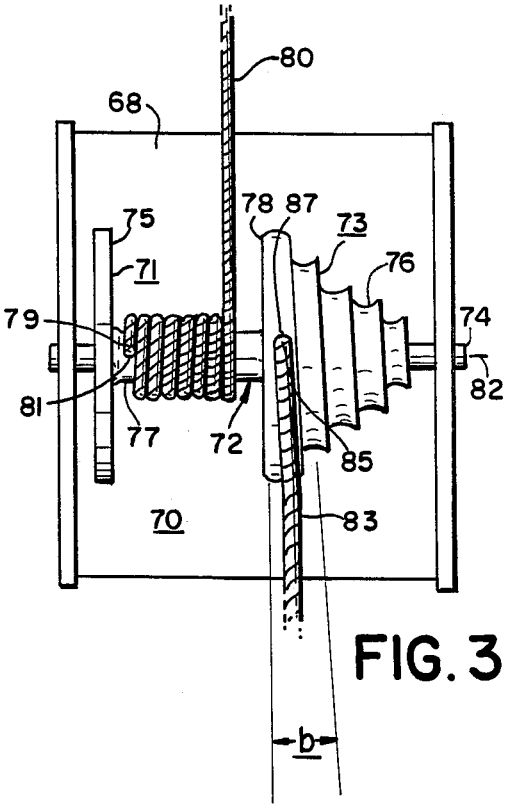
FIG. 3 is an enlarged view of the circled portion in FIG. 2 designated III.
Figure 5:
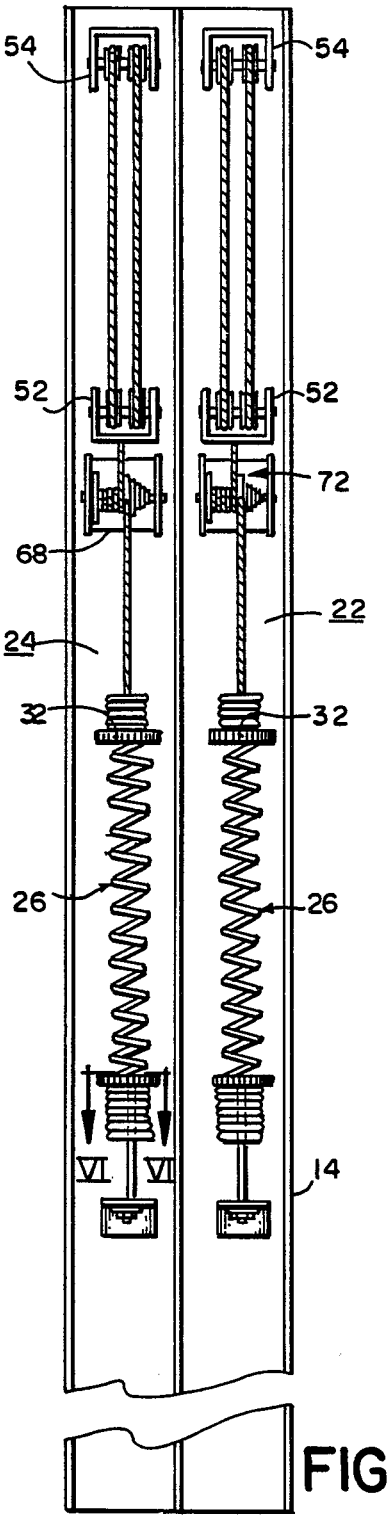
FIG. 5 is a section view taken along the line V—V in FIG. 4.
Figure 4:
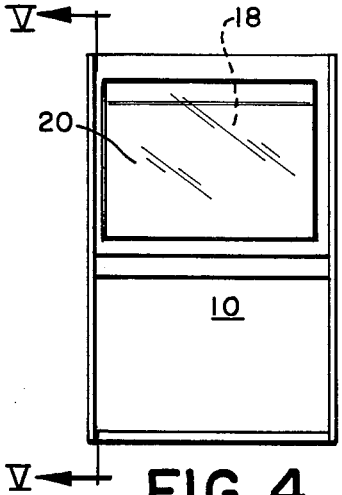
FIG. 4 is a front elevation of the window assembly of FIG. 1, wherein the lower sash has been raised.
Figure 6:
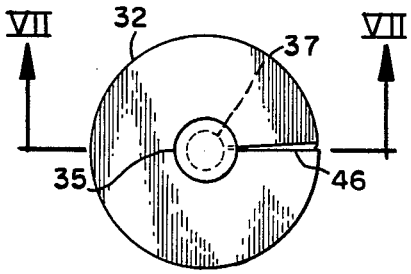
FIG. 6 is a section view taken along the line VI—VI in FIG. 5.
Figure 7:
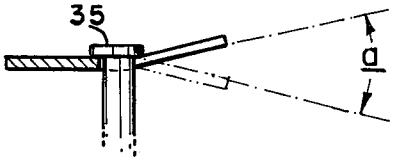
FIG. 7 is a section view taken along the line VII—VII in FIG. 6.

The variable rate cable system 70 comprises at least one winding means and includes at least one member of varied diameter. As best shown in FIG. 3, a presently preferred embodiment of a winding means 72 comprises two constituent parts, a drum portion 71 and a generally conical pulley portion 73, which are fixed for rotation on shaft 74. Shaft 74 may be rotatably mounted in a bracket 68, the bracket 68 being affixed to the frame 14. Fixed brackets 40, 54 and 68 may be integrally formed on a single, elongated member adapted for attachment to the interior or frame 14, or alternatively, may be formed integrally with the frame member itself.

The drum portion 71 has a drum 77 of uniform or constant diameter. Drum 77 is bounded on one side by sheave 75 and on the other side by the side face 78 of the larger diameter axial end of generally conical pulley portion 73. Generally conical pulley portion 73 has a continuous spiral groove 76, the radius of which spiral is increasingly smaller as the spiral travels around the axis 82.

The variable cable rate system 70 operates with second cable means 80 the third cable means 83. One end 79 of the second cable means 80 is affixed to the left side of the drum 77 at a point 81. The other end of second cable means 80 is affixed to the movable end of the constant rate cable system, for example by attachment to movable bracket 52. One end 85 of the third cable means 83 is affixed to one end of the spiral groove 76, at point 87, point 87 being at the larger diameter end of the generally conical pulley portion 73. The other end of the third cable means 83 is affixed to the upper, movable end 28 of the biasing means 26, in this embodiment, spring 27. It will be appreciated that when the winding means 72 rotates in a direction whereby second cable means 80 pays out from the drum portion 71, third cable means 83 will simultaneously be wound onto the generally conical pulley portion 73. Conversely, whenever the winding means rotates in a direction enabling second cable means 80 to be wound onto the drum portion 71, the third cable means 83 will be paid out from the generally conical pulley portion 73. In other words, the second and third cable means always wind oppositely to one another, irrespective of the direction of rotation of the winding means 72. However, due to the varying diameter of the spiral pulley portion of the generally conical pulley portion 73, it will be appreciated that the second and third cable means will be wound onto and off of the winding means 72 at different rates from one another. Nevertheless, despite the opposite sense in which the second and third cable means are wound onto and off of the winding means 72 for a given direction of rotation, it will be appreciated that paying out of the second cable means 80 and winding on of the third cable means 83 correspond to upward movement of both the movable end 52 of the constant rate cable system and the movable end 28 of the biasing means. Conversely, the winding on of the second cable means 80 and the paying out of the third cable means 83 corresponds to downward movement of both the movable end 52 of the constant rate cable system and the movable end 28 of the tensioning means. Although the movable ends of the constant rate cable system and the biasing means therefore move in the same direction, either upwardly or downwardly, such movement will take place at different speeds relative to one another, due to the difference in the rates at which the second and third cable means are wound onto and off of the winding means 72 from the fixed diameter and varied diameter portions thereof. Consequently, the movable ends may move different distances.

The compact and substantially linear geometry of the compound counterbalance system according to this embodiment enables the systems to be easily incorporated into the side frames of window assemblies.

The mechanical interaction of the various components of the compound counterbalance systems 22 and 24 is such that when sashes are moved upwardly, the movable bracket 52 and the movable end 28 of the spring move downwardly, and when sashes are moved downwardly, the movable bracket 52 and the movable end 28 of the spring moves upwardly. The variable rate of the variable rate cable means, which is determined by the dimensions of the spiral groove and the diameter of the drum 77, may be predetermined to automatically compensate for the inherent variability in the spring rate or gradient of the tension in the biasing means. The resultant interaction of the components provides substantially constant force counterbalancing with ease of operation, even with highly efficient weather seals and heavy sashes.

Figure 8:
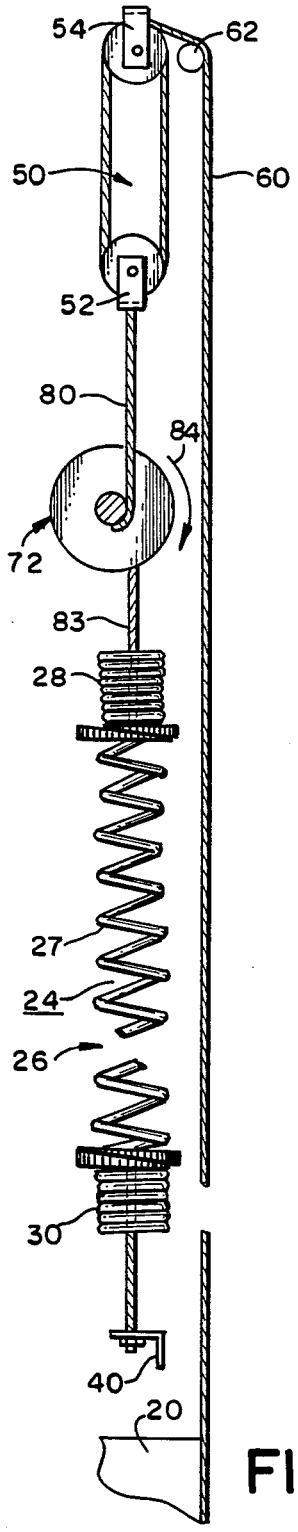
FIG. 8 is a section view taken along the line VIII—VIII in FIG. 2, but in enlarged scale.
Figure 9:
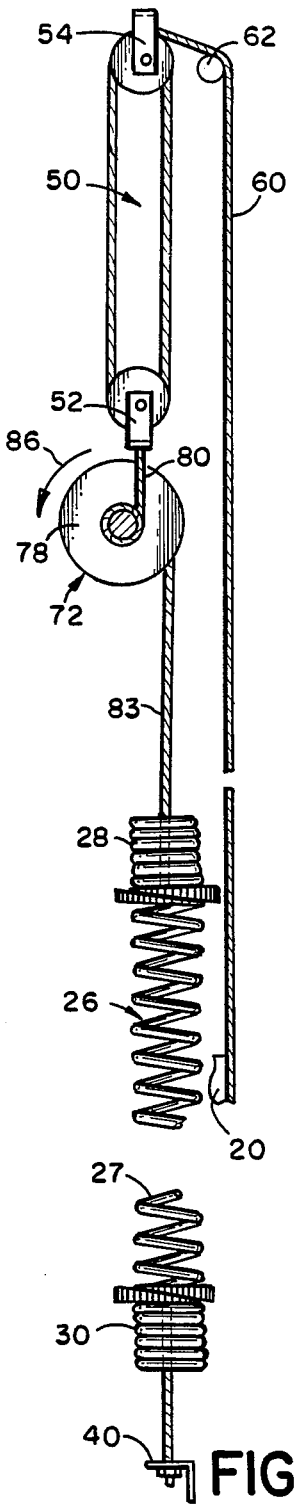
FIG. 9 illustrates the system of FIG. 8, after a lower window has been moved from a closed to an open position.
Figure 11:
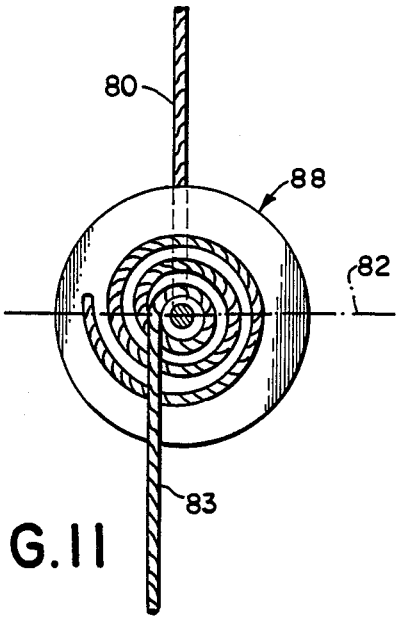
FIG. 11 is a section view taken along the line XI—XI in FIG. 10.
Figure 10:
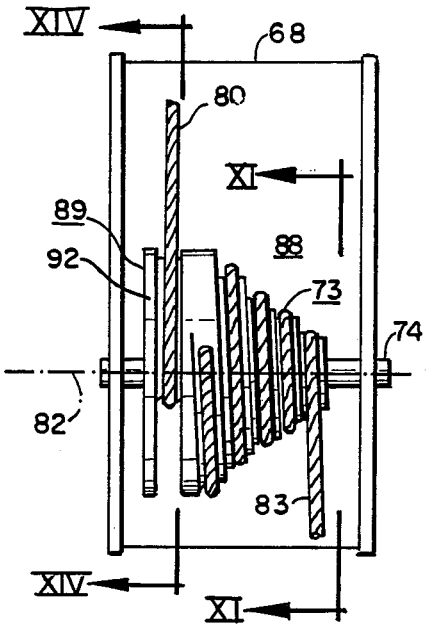
FIG. 10 illustrates an alternative embodiment of the variable rate cable system, which can be incorporated into the compound counterbalance systems shown in FIGS. 1–9.
Figure 13:
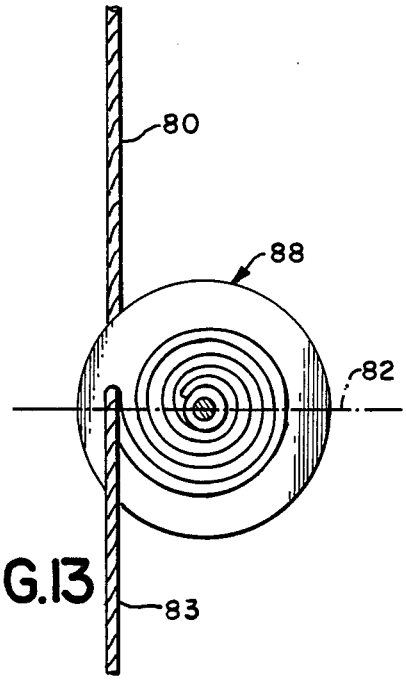
FIG. 13 is a section view taken along the line XIII—XIII in FIG. 12.
Figure 12:
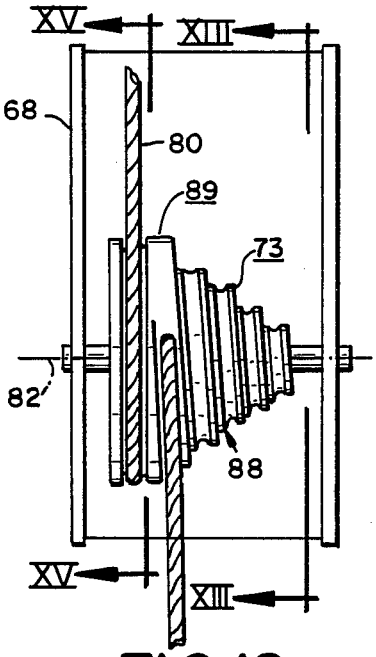
FIG. 12 illustrates the embodiment of FIG. 10, in a different working position.

The respective movements of the components of the compound counterbalance systems 22 and 24 can be appreciated by comparing: FIGS. 1 and 2 to FIGS. 4 and 5; FIG. 8 to FIG. 9; and for another embodiment, FIGS. 10 and 11 to FIGS. 12 and 13. In FIG. 1, both the upper sash 18 and the lower sash 20 are closed. The counterbalance system 22 is connected to the upper sash 18. Accordingly, in FIG. 2, the movable end 52 of the constant rate cable system is shown in its lowermost position, which is at its closest position to winding means 72. Conversely, the movable end 28 of spring 27 is at its lowermost position, at its furthest position from winding means 72. Counterbalance system 24 is connected to the lower sash 16. In this position, the movable end 52 of the constant rate cable system is at its uppermost position, most distant from winding means 72. Movable end 28 of spring 27 is at its uppermost point, closest to pulley winding means 72. The third cable means 82 is substantially wound about the entire groove 76, and second cable means 80 is maximally paid out from drum portion 71, when a lower sash or vent is closed and when an upper sash vent is opened. Conversely, third cable means 83 is maximally paid out from the groove, and second cable means 80 is maximally wound onto drum portion 71, when an upper sash is closed and a lower sash is opened. This can be appreciated from FIG. 4, wherein the lower sash 20 has been opened by upward movement, overlying upper sash 18. It can be seen from FIG. 5 that counterbalance system 24 has assumed an orientation wherein its components are positioned similarly, if not substantially identically to counterbalance system 22. Had the upper sash 18 of window assembly 10 been lowered, instead, then counterbalance system 22 would appear much as does counterbalance system 24 in FIG. 2. Typically two counterbalance systems would be provided for each sash, one on each side thereof.

The spiral nature of the pulley can be also seen in FIGS. 8 and 9. FIG. 8 corresponds to counterbalance system 24 as shown in FIG. 2, wherein the lower sash 10 is in its closed position. As shown, third cable means 83 extends from the smallest diameter portion of the groove 76 in FIG. 8 radially close to shaft 74 and axis 82. FIG. 9 represents the system of FIG. 8 after the lower sash 20 has been moved upwardly. Movable ends 52 and 28 move downwardly, third cable means 83 pays off of spiral groove 76 and second cable means 80 is wound onto drum portion 71. At the end of the movement, second cable means 83 extends from the largest diameter portion of groove 76, radially spaced from the shaft 74. In order to move from the orientation of FIG. 8 to the orientation of FIG. 9, the winding means 72 must rotate clockwise, as shown by arrow 84. During this clockwise rotation, second cable means 80 moves downwardly, winding onto the drum portion 71, and third cable means 83 moves downwardly, winding off of generally conical pulley operation 73. When moving from the position shown in FIG. 9 to the position in FIG. 8, winding means 72 rotates counterclockwise, as shown by arrow 86. At the same time, second cable means 80 moves upwardly, paying out from drum portion 71, and third cable means 83 moves upwardly, winding onto generally conical pulley portion 73.

Figure 14:
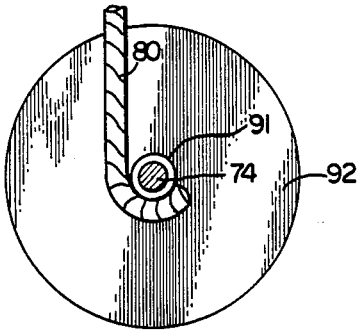
FIG. 14 is a section view taken along line XIV—XIV in FIG. 10.
Figure 15:
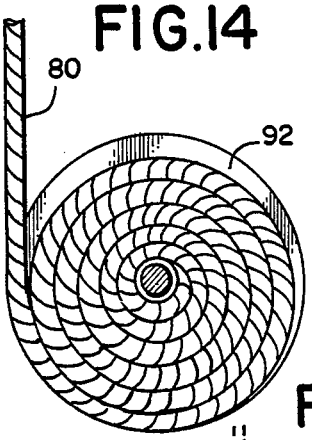
FIG. 15 is a section view taken along line XV—XV in FIG. 12.

An alternative winding means for the variable rate cable system is shown in FIGS. 10–15. A winding means 88 has a generally conical pulley portion 73 corresponding to generally conical pulley portion 73 as shown in FIG. 3. However, a winding drum portion 89 has a much axially narrower drum 91 (FIG. 14). In fact, the distance between sheave 92 and the left side face (in the orientation or FIG. 10) of generally conical pulley portion 73 is only slightly wider than the diameter of second cable means 80. Accordingly, each subsequent turn of second cable means 80 on the drum portion 89 fits over the preceding turn, as shown in FIG. 15. This may be contrasted with the turns of second cable means 80 is the embodiment shown in FIG. 3, wherein each of the turns has the same diameter. Accordingly, the winding means 88 of the embodiment shown in FIGS. 10–15 has two portions of varied diameter, as different lengths of second cable means 80 will be wound onto and paid out from drum portion 89 for each subsequent rotation of the winding means 88. This embodiment is preferred over that shown in FIG. 3 insofar as the winding means 88 is considerably axially narrower than winding means 72. However, it may be more difficult to design winding means 88 to compensate for changes in the spring rate or gradient of the tensioning means, as the calculations are more complex because two interacting variable rates must be taken into account. Indeed, the dimensions and configuration for each spiral groove will differ for biasing means of different characteristics. In all other respects, winding means 88 function in a manner which is similar to that of winding means 72.

Figure 17:
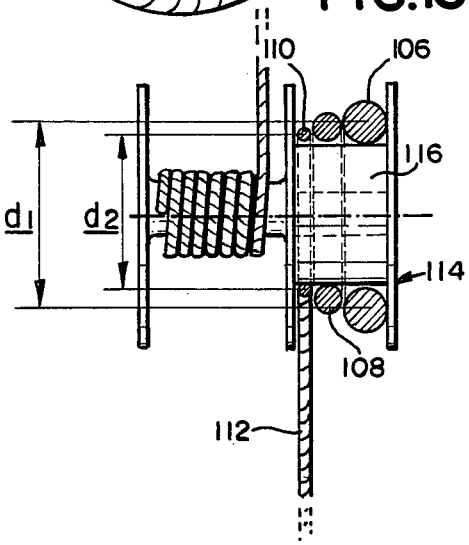
FIGS. 16 and 17 illustrate a variable diameter cable and a fixed diameter drum pulley, arranged to function as yet a further alternative variable rate cable means.
Figure 16:
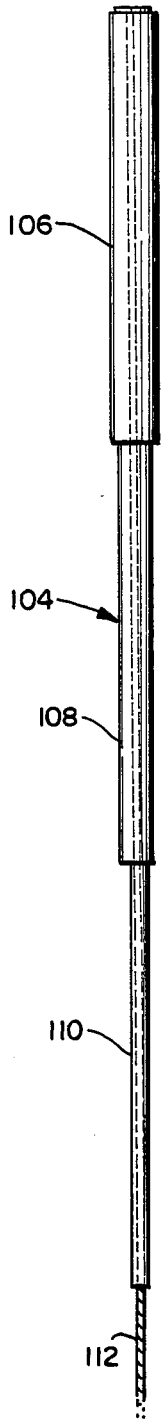

A further enbodiment for a variable rate cable means is shown in FIGS. 16 and 17. In this embodiment, cable means 104 is provided with different segments of varied diameter, for example a thickest diameter portion 106, a thinnest diameter portion 112 and portions 108 and 110 of intermediate thickness or diameter. A pulley 114 has a single drum 116 of fixed diameter, coaxially mounted on axis 82 and fixed to a drum portion 71, as in FIG. 3. The end of the thickest segment is fixed to the drum 116. It can be seen from FIG. 18 that the diameter d1 of the somewhat helical loop formed by segment 106 is greater than the diameter d2 of thinner segment 110. Accordingly, the winding and unwinding of segment 106 will effect a greater upward and downward movement of the movable end of the spring than will the paying out of segments 108 and 110, and that the paying in and out of segment 108 will effect greater movement than the paying in and out of segment 110.

Figure 18:
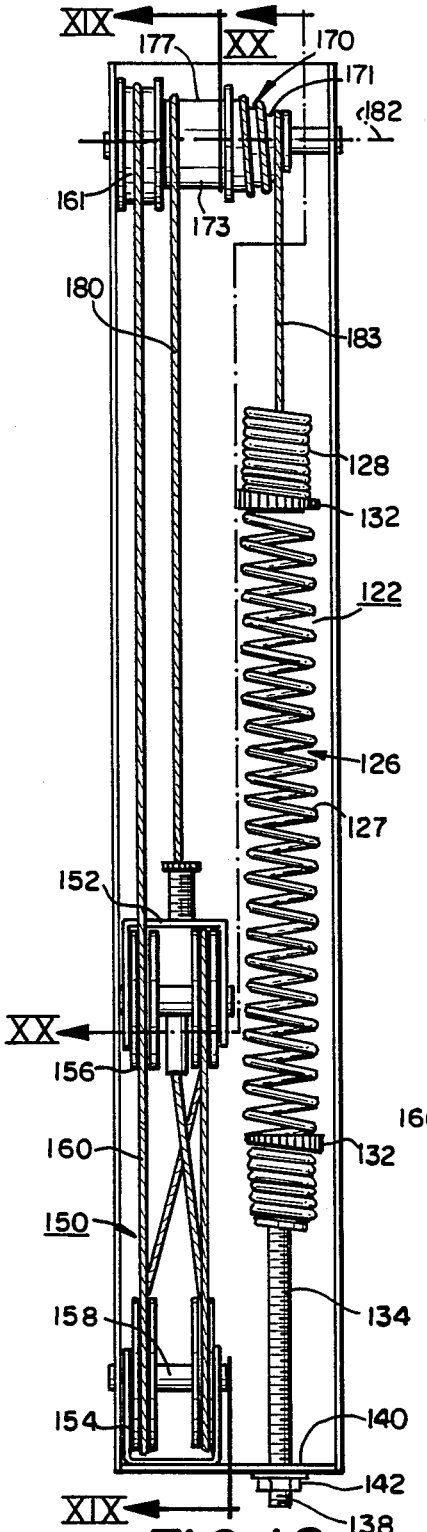
FIG. 18 illustrates an alternative embodiment wherein the biasing means and the block and tackle pulley assembly are disposed beside one another.
Figure 19:
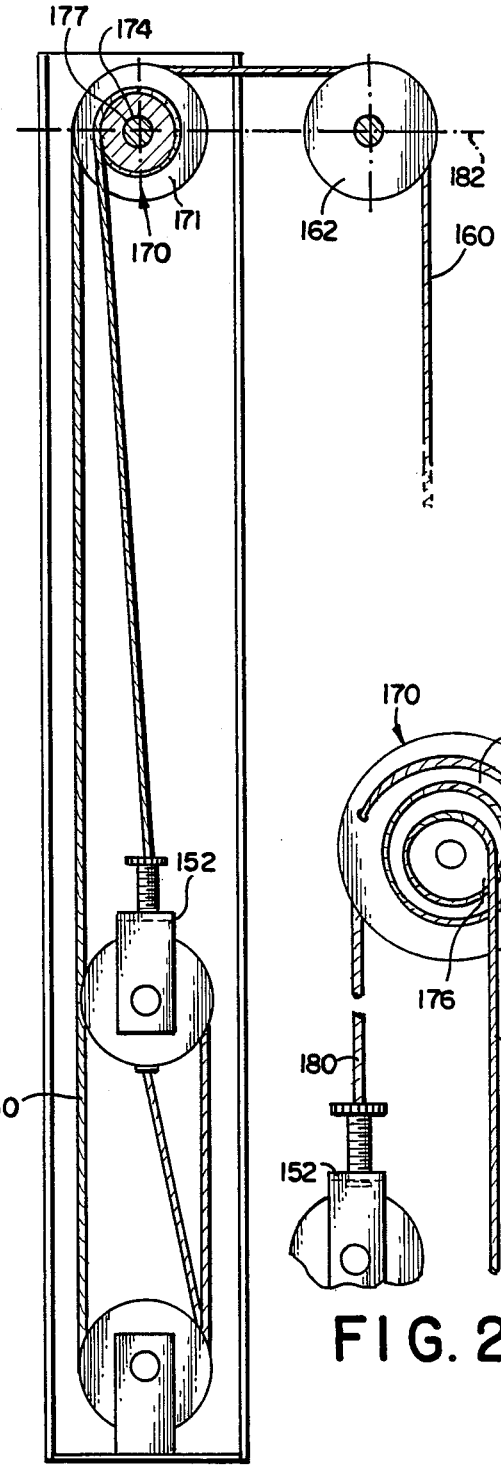
FIG. 19 is a section view taken along the line XIX—XIX in FIG. 18.
Figure 20:
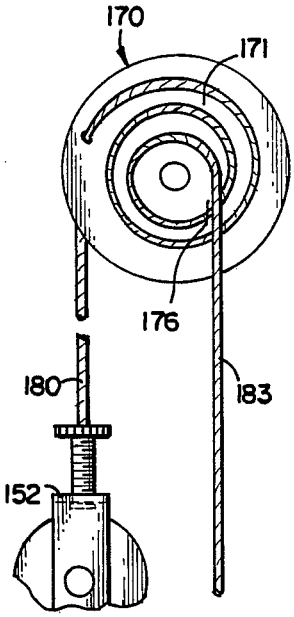
FIG. 20 is a view taken along the line XX—XX in FIG. 18.

The embodiment shown in FIGS. 18–20 operates similarly to that shown in FIGS. 1–3, but presents an alternative spatial arrangement wherein the counterbalance system has essentially been folded around the axis 82 (182) around which the generally conical pulley/cable drum rotates. In the orientation of compound counterbalance system 122, the biasing means or system 126 operates side-by-side with constant rate cable means or system 150. A variable rate cable means or system 170 is operationally interposed between the constant rate cable means and the biasing means.

The biasing means or system 126 is a linearly extensible and contractible biasing means, for example a helically wound spring 127. Each spring 127 has movable end 128 and fixed end 130. An adjustment knob 132 is disposed adjacent each end of the spring. A rod 134 has a head which is larger in diameter than a hole in the middle of adjustment knob 132, as in the case of adjustment knob 32, shown in FIGS. 6 and 7. Rod 134 has a threaded end 138 which passes through a hole in a mounting bracket 140 and is secured in place by a nut and lock washer assembly 142. The adjustment knob 132 has a radial slit which enables the facing slit edges of the knob to be bent upwardly and downwardly relative to one another. The movable end of the spring may be directly connected to a cable, by having the cable pass through the hole in the adjustment knob and having a retainer or fitting affixed thereto, the size of the retainer being larger than the hole. The dimensions of knob 132 are such that the turns of the spring fit between the separated edges of the knob 132. Rotation of the knob(s) 132 effects axial movement of the knob(s), such that the number of turns of the spring under tension can be increased or decreased, thereby enabling the magnitude of the tension or biasing force to be adjusted. Adjustment can also be affected by the extent to which threaded end 138 is pulled or tightened through bracket 140. Such adjustments may effect the range and magnitude of the spring gradient, but will not compensate for the gradient.

The constant rate cable means or system 150 has a movable end defined by a bracket 152 and a fixed end defined by a bracket 154. Each of the brackets 152, 154 has brackets 156 disposed on mounting shafts 158. The pulleys 156 are engaged by a first cable means 160 so as to form a block and tackle assembly providing a mechanical advantage in the system. In the illustrated embodiment, the ratio of the mechanical advantage is 4:1 or 1:4 depending upon the chosen reference. One end of the cable means 160 is entrained over guide pulleys 161 and 162 and affixed to a window sash.

The variable rate cable system 170 comprises at least one winding means and includes at least one member of varied diameter. A winding means 172 comprises a drum portion 171 and a generally conical pulley portion 173, each of which is fixed for rotation on shaft 174 about axis 182. Shaft 174 may be rotatably mounted in a bracket affixed to the window frame. As in the first illustrated embodiment, the fixed brackets may be integrally formed on a single, elongated member adapted for attachment to the interior of the window frame, or alternatively, may be formed integrally with the frame member itself.

The drum portion 171 has a drum 177 of uniform or constant diameter. Drum 177 is bounded on one side by a sheave and on the other side by the side face of the larger diameter axial end of generally conical pulley portion 173. Generally conical pulley portion 173 has a continuous spiral groove 176, the radius of which spiral is increasingly smaller as the spiral travels around the axis 182.

The variable rate cable system 170 operates with second cable means 180 and third cable means 183. One end of the second cable means 180 is affixed to the drum 177. The other end of second cable means 180 is affixed to the movable end of the constant rate cable system, for example by attachment to movable bracket 152. One end of the third cable means 183 is affixed to the end of the spiral groove 176, at a point forming the largest effective diameter of the generally conical pulley portion 173. The other end of the third cable means 183 is affixed to the movable end 128 of the biasing means 126, namely spring 127. As in the first embodiment, when the winding means 172 rotates in a direction whereby second cable means 180 pays out from the drum portion 171, third cable means 183 will simultaneously be wound onto the generally conical pulley portion 173. Conversely, whenever the winding means rotates in a direction enabling second cable means 180 to be wound onto the drum portion 171, the third cable means 183 will be paid out from the generally conical pulley portion 173. The second and third cable means always wind oppositely to one another, irrespective of the direction of rotation of the winding means 172. The operation of the embodiment shown in FIGS. 18–20 is fully consistent with the embodiment shown in FIGS. 1–3.

An alternative first biasing force transmission means for imparting a mechanical advantage to the system is shown in FIGS. 21–23. Such a biasing force transmission means 200 utilizes gear means instead of cable and pulley means. In order to demonstrate how such a transmission means may be connected, FIG. 22 corresponds operationally to FIG. 3 of the first illustrated embodiment; that is, an upper sash in a closed position, or a lower sash in an opened position. FIG. 21 corresponds to the opposite operational condition from FIG. 22. Each is used with the same spring 27 and cable means 83 connected between the movable end of the spring and the generally conical pulley. Each also has the cable means 60 connecting the window sash or the like and the cable drum.

The biasing force transmission means 200 comprises a generally conical, spiral-grooved pulley/gear means 202, a cluster gear 230 and a cable drum/gear means 210. The pulley/gear means 202 comprises a generally conical spiral-grooved pulley portion 204 having a spiral groove 208 formed therein, and a gear 206 formed integrally with, or fixed for rotation together therewith. The pulley/gear means 202 is rotatably mounted on shaft 218. Cable drum/gear means 210 is also rotatably mounted on shaft 218, and is rotatable independently of pulley/gear means 202. The pulley/gear means and cable drum/gear means are separated from one another by a spacer 216 which, although shown as a separate member, may be formed integrally with one or the other of the members which it separates. The cluster gear 230 is rotatably mounted on shaft 238. Alternatively, of course, cluster gear 230 could be fixed for rotation with shaft 238, if shaft 238 were itself mounted for rotation. Cluster gear 230 comprises a smaller diameter gear 232 and a larger gear 234, fixed for rotation together by a common hub 236.

Cable drum/gear means 210 comprises a cable drum portion 212 and a gear 214 formed integrally therewith, and forming one sheave of the cable drum. Gears 206 and 232 are interengaged and gears 234 and 214 are interengaged. Considered apart from the system, and assuming that the ratio of diameters (or radii) is such that gear 206 is twice the size of gear 232 and gear 234 is twice the size of gear 214, rotation of gear 214 will cause rotation of gear 234 at one half the original rotational speed of gear 214. Gear 232 rotates at the same speed as gear 234. The further rotation of gear 206 by gear 232 will cause gear 206 to rotate at one half the rotational speed of gears 232 and 234. If gear 206 is considered to drive gear 232, which in turn drives gear 214 through gear 234, then gear 214 will rotate at four times the rotational speed of gear 206, and cable 60 will travel four times as fast as cable 83 but at a power reduction of 4:1. The effect is that of two successive reduction gear sets of ratio 2:1.

FIG. 21 may be thought of as operationally corresponding to a lower window sash in a fully closed position, wherein cable means 80 is fully paid out from cable drum 212 and spring 27 is fully extended, so that cable means 83 is fully wound onto pulley 204. FIG. 22 corresponds to the lower window sash in the fully opened position, wherein cable means 60 is fully wound onto cable drum 212, the spring 27 is fully retracted or relaxed and cable means 83 is paid out fully from generally conical pulley 204. Closing a fully opened lower sash results in spring 27 moving from a fully contracted to a fully extended position (from FIG. 22 to FIG. 21). Such movement requires that cable 60 pay out from cable drum 212. As cable means 60 pays out from cable drum 212, it causes rotation of gear 214, which causes rotation of gear 234, which causes rotation of gear 232, which causes rotation of gear 206. Gear 206 is rotating at one fourth the rotational speed of cable drum 212, but the power of rotation has been increased by a factor of four. Accordingly, a mechanical advantage of the gear means is available to assist in extending and tensioning spring 27, so that it will have sufficient potential energy stored therein to enable the window sash to be easily moved when next opened.

Such a geared system may also suggest other alternatives to those skilled in the art, for example, a system wherein cable means 60 is eliminated altogether, and gear 214, or another gear driven by gear 214, is adapted to directly drive a rack formed along the vertical edge of a window sash. Such an embodiment would eliminate all cables, except for a cable means, which might even be part of the biasing means itself, between the movable end of the biasing means and the generally conical pulley. It will also be appreciated by those skilled in the art that spring 27 could be folded around the generally conical pulley 204 so as to be arranged next to cable means 60 or any other relative angle. It will be further appreciated that the cable drum forms part of the first biasing force transmission means in the geared embodiments and part of the second biasing force transmission means in the cable-only embodiments.

The invention can be easily utilized in contexts other than window sash balance systems and the like, and accordingly, the invention may also be embodied in the compound winding apparatus, comprising: a generally conical, spiral-grooved pulley adapted to engage a first cable means windable into and out of the spiral groove at a variable rate as the pulley rotates; a drum adapted to engage a second cable means windable onto and off of the drum at a substantially constant rate as it rotates, the pulley and the drum being at least indirectly engaged to undergo simultaneous rotation; and, the variable rate being predetermined to automatically compensate for inherent variation in a biasing force transmitted through one of the first and second cable means, whereby a substantially constant force is transmitted through the other of the first and second cable means. According to various embodiments of such a compound winding apparatus, the pulley and the drum may be fixed to one another for rotation at the same speed and in the same direction, by being fixed to a common shaft for rotation or by being formed integrally with one another or by being fixed to one another for common rotation on a shaft. Alternatively, the pulley and the drum may be indirectly linked by mechanical means for rotation at the same speed or for rotation at different speeds. Rotation at different speeds may be achieved wherein the mechanical means comprises at least one reduction gear assembly, the drum being connected for rotation at a speed faster than the pulley by a multiple related to the reduction ratio of the at least one gear assembly. In either case, at least one gear may be formed integrally with each of the pulley and the drum. The compound winding apparatus may further comprise a block and tackle means imparting a mechanical advantage in operation, having a movable end connected to the second cable means and a pulley-entrained cable having a free end which moves through a first range of movement larger than a second range of movement defined by the first cable means by a multiple related to the ratio of the mechanical advantage of the block and tackle means.

As the various mechanical embodiments indicate, the invention also comprises a method for counterbalancing a load against forces tending to retard movement thereof; compounding the biasing force with a compensating force at a variable rate predetermined to automatically compensate for characteristic variability of the biasing force to provide a substantially constant compound biasing force; and, transmitting the substantially constant compound biasing force to the load through a mechanical system configured to increase the range of movement in which the biasing force is transmitted to the load and increase the distance of travel of the load relative to parts of the biasing means, whereby the effect of the biasing force is uniform. In each of the preferred embodiments, the biasing force is executed by substantially linear extension and contraction of spring means. The specific dimensions, spring gradients and the like of any particular compound counterbalance system to this invention, irrespective of the nature of the particular mechanical embodiment, will inevitably vary for windows or other loads of different size, shape, weight and choice of materials in slides and tracks. However, several restraints and operating factors are common to all such systems, particularly windows, such as size, weight and coefficients of friction (sliding and static), and a consideration of such restraints will enable those skilled in the art to practice the method and apply the teachings of this invention in specific instances.

The overall mechanical effect of the combination generally conical pulley/cable drum will be determined by the relationship between the effective radius of the generally conical pulley and the fixed radius of the cable drum. The effective radius of the spiral pulley in turn should be predetermined to automatically compensate for the inherent variability in the spring rate of gradiants of the tension in the spring. The overall result is a substantially constant biasing force. Accordingly, in order to precisely compensate for variations in the spring rate or force gradient of the biasing means, the variation of the spring rate or force gradient must be determined first.

This invention may be embodied in other specific forms without departing from the spirit or essential attributes thereof. Accordingly, reference should be made to the appended claims, rather than to the foregoing specification, as indicating the scope of the invention.

What is claimed is:

1, A compound counterbalance system for window sashes and the like comprising:

biasing means for easing operation of a window sash and the like, the biasing means being movable at an inherently variable rate of force;

a first biasing force transmission means, connected intermediately of the window sash and the like and the biasing means, for increasing the effective range of movement of the biasing means; and, a second biasing force transmission means connected intermediately of the window sash and the like and the biasing means, the second biasing force transmission means having a variable rate of operation predetermined to automatically compensate for the variability of the biasing means to provide substantial constancy of the biasing force.

2. The compound counterbalance sytem of claim 1, wherein the second biasing force transmisson means is connected intermediately of the first biasing force transmission means and the biasing means.

3. The compound counterbalance system of claim 1, wherein the biasing means comprises linearly extensible and contractible means.

4. The compound counterbalance system of claim 1, wherein the second biasing force transmission means comprise a generally conical, spiral-grooved pulley and a cable means affixed at one end to the pulley, affixed at the other end to the biasing means and adapted to wind into and out of the groove.

5. The compound counterbalance system of claim 3, wherein the second biasing force transmission means comprises: a generally conical, spiral-grooved pulley and a cable drum fixed for rotation together; a first cable means affixed at one end to the pulley, affixed at the other end to the movable end of the biasing means and adapted to wind into and out of the groove as the biasing means extends and contracts; and, a second cable means affixed at one end to the cable drum and adapted to wind onto and off from the cable drum and connectable to the first biasing force transmission means at the other end.

6. The compound counterbalance system of claim 1, wherein the second biasing force transmission means comprises: a first cable drum of constant diameter and a cable means having sections of different diameter and a second cable drum fixed for rotation together with the first cable drum; a first cable means affixed at one end to the pulley, affixed at the other end to the movable end of the biasing means and adapted to wind into and out of the groove as the biasing means extends and contracts; and, a second cable means affixed at one end to the second cable drum and adapted to wind onto and off from the second cable drum and connectable to the first biasing force transmission means at the other end.

7. The compound counterbalance system of claim 1, wherein the first biasing force transmission means comprises pulleys and cable means.

8. The compound counterbalance system of claim 1, wherein the pulley and cable means comprises a block and tackle assembly having fixed and movable ends and first and second cable means, the first cable means being entrained around the pulleys to impart the effective increase in the range of movement of the biasing means and connectable to the window sash and the like, and the second cable means connecting the movable end with the second biasing force transmission means.

9. The compound counterbalance system of claim 1, wherein the first biasing force transmission means comprises gear means.

10. The compound counterbalance system in claim 9, wherein the gear means comprises at least one reduction gear set to impart the effective increase in the range of movement of the biasing means.

11. The compound counterbalance system of claim 4, wherein the first biasing force transmission means comprises at least one reduction gear set to impart the effective increase in the range of movement of the biasing means.

12. The compound counterbalance system of claim 11, wherein at least one gear set comprises: a first gear linked to the generally conical pulley; a cable drum; a second gear linked to the cable drum and in at least indirect engagement with the first gear; and, a second cable means, having one end affixed to the cable drum and adapted to wind onto and off from the drum and having the other end connectable to the window sash and the like.

13. The compound counterbalance system of claim 12, wherein gears are formed integrally with each of the generally conical pulley and the cable drum.

14. The compound counterbalance system of claim 1, wherein:

the biasing means comprises a linearly extensible spring, having one fixed end and one movable end;

the second biasing force transmission means comprises: a generally conical, spiral-grooved pulley and a cable drum fixed for rotation together; a first cable affixed at one end to the pulley, affixed at the other end to the movable end of the spring and adapted to wind into and out of the groove as the spring extends and contracts; and, a second cable means affixed at one end to the cable drum and adapted to wind onto and off from the cable drum and connectable to the first biasing force transmission means at the other end; and, the first biasing force transmission means comprises pulleys and cable means interconnected to form a block and tackle assembly, the cable means being entrained around the pulleys to impart the effective increase in the range of movement of the biasing means.

15. The compound counterbalance system of claim 1, wherein:

the biasing means comprises a linearly extensible spring, having one fixed end and one movable end;

the second biasing force transmission means comprises: a generally conical, spiral-gooved pulley; a first cable means affixed at one end to the pulley, affixed at the other end to the movable end of the spring and adapted to wind into and out of the groove as the spring extends and contracts; and, the first biasing force transmission means comprises: gear means having at least one gear reduction set to impart the effective increase in the range of movement of the biasing means for the system; a cable drum in indirect engagement with the pulley through the at least one gear reduction set; and, a second cable means affixed at one end to the cable drum and adapted to wind onto and off from the cable drum and connectable to the window sash and the like.

16. The compound counterbalance system of claim 1, in combination with a manufactured window assembly having at least one openable window sash.

17. The combination of claim 16, wherein:

the biasing means comprises a linearly extensible spring, having one fixed end and one movable end;

the second biasing force transmission means comprises: a generally conical, spiral-grooved pulley and a cable drum fixed for rotation together; a first cable means affixed at one end to the pulley, affixed at the other end to the movable end of the spring and adapted to wind into and out of the groove as the spring extends and contracts; and, a second cable means affixed at one end to the cable drum and adapted to wind onto and off from the cable drum and connectable to the first biasing force transmission means at the other end; and, the first biasing force transmission means comprises pulleys and cable means interconnected to form a block and tackle assembly, the cable means being entrained around the pulleys to impart the effective increase in the effective range of movement of the biasing means.

18. The combination of claim 16, wherein:

the biasing means comprises a linearly extensible spring, having one fixed end and one movable end;

the second biasing force transmission means comprises: a generally conical, spiral-grooved pulley; a first cable means affixed at one end to the pulley, affixed at the other end to the movable end of the spring and adapted to wind into and out of the groove as the spring extends and contracts; and, the first biasing force transmission means comprises: gear means having at least one gear reduction set; a cable drum in indirect engagement with the pulley through the at least one gear reduction set; and, a second cable means affixed at one end to the cable drum and adapted to wind onto and off from the cable drum and connectable to the window sash and the like.

19. A method for counterbalancing a load, comprising the steps of:

exerting by movement a biasing force on the load against forces tending to retard movement thereof;

compounding the biasing force with a compensating force at a variable rate predetermined to automatically compensate for characteristic variability of the biasing force to provide a substantially constant compound biasing force; and, transmitting the substantially constant compound biasing force to the load through a mechanical system configured to increase the range of movement in which the biasing force is effective, whereby the effect of the biasing force is uniform.

20. The method of claim 19, comprising the step of exerting the biasing force by substantially linear extension and contraction of spring means.

21. A compound winding apparatus, comprising:

a generally conical, spiral-grooved pulley adapted to engage a first cable means windable into and out of the spiral groove at a variable rate as the pulley rotates;

a drum adapted to engage the second cable means windable onto and off of the drum at a substantially constant rate as the drum rotates, the pulley and the drum being at least indirectly engaged to undergo simultaneous rotation; and, mechanical means indirectly linking the pulley and drum for rotation at different speeds, the variable rate being predetermined to automatically compensate for inherent variation in a biasing force transmitted through one of the first and second cable means, whereby a substantially constant force is transmitted through the other of the first and second cable means.

22. The compound winding apparatus of claim 21, wherein the mechanical means comprises at least one reduction gear assembly.

23. The compound winding apparatus of claim 22, wherein the drum is connected for rotation at a speed faster than the pulley by a multiple related to the reduction ratio of the at least one gear assembly.

24. The compound winding apparatus of claim 22, wherein at least one gear is formed integrally with each of the pulley and the drum.

25. A compound winding apparatus, comprising:

a generally conical, spiral-grooved pulley adapted to engage a first cable means windable into and out of the spiral groove at a variable rate as the pulley rotates;

a drum adapted to engage the second cable means windable onto and off of the drum at a substantially constant rate as the drum rotates, the pulley and the drum being at least indirectly engaged to undergo simultaneous rotation; and, a block and tackle means imparting a mechanical advantage in operation, having a movable end connected to the second cable means and a pulley-entrained cable having a free end which moves through a first range of movement larger than a second range of movement defined by the first cable means by a multiple related to the ratio of the mechanical advantage of the block and tackle means, the variable rate being predetermined to automatically compensate for inherent variation in a biasing force transmitted through one of the first and second cable means, whereby a substantially constant force is transmitted through the other of the first and second cable means.

* * * * *